United States Patent [19]

Panken

[11] 3,979,550

[45] Sept. 7, 1976

[54] PRE-PRINTED LATENT IMAGE SPIRIT DUPLICATING MASTERS

[75] Inventor: Irving Panken, Dayton, Ohio

[73] Assignee: The Mazer Corporation, Dayton, Ohio

[22] Filed: Dec. 10, 1975

[21] Appl. No.: 639,351

Related U.S. Application Data

[63] Continuation of Ser. No. 434,559, Jan. 18, 1974, abandoned.

[52] U.S. Cl. ..... 428/488; 101/DIG. 1; 101/472; 101/473; 106/21; 106/31; 35/9 G; 427/144

[51] Int. Cl.[2] ..... B41M 5/04

[58] Field of Search ..... 106/21, 31; 101/472, 101/473, DIG. 1; 427/144; 35/96; 428/488

[56] References Cited

UNITED STATES PATENTS

| | | | |
|---|---|---|---|
| 2,748,024 | 5/1956 | Klimkowski et al. | 106/21 X |
| 3,451,143 | 6/1969 | Thomas et al. | 35/9 G |
| 3,682,673 | 8/1972 | Manske | 35/9 G |
| 3,784,394 | 1/1974 | Bildusas et al. | 427/56 |
| 3,931,443 | 1/1976 | Neale | 427/149 |

*Primary Examiner*—Ralph S. Kendall
*Assistant Examiner*—John D. Smith
*Attorney, Agent, or Firm*—Biebel, French & Nauman

[57] ABSTRACT

A pre-printed spirit duplicating master containing visible imaged material and latent imaged material for use in preparing copies for self-instructional examination or work assignments. The latent images on the copy sheet are capable of being revealed with a pen containing a chemical developer and this can be done by the student in self-examination. The use of the pre-printed masters frees the teacher from the chore of preparing exams, or work assignments, making the masters, and from grading the papers.

18 Claims, 4 Drawing Figures

PRE-PRINTED LATENT IMAGE SPIRIT DUPLICATING MASTERS

CROSS REFERENCE TO RELATED APPLICATIONS

This application is a continuation of application Ser. No. 434,559, filed Jan. 18, 1974, now abandoned.

BACKGROUND OF THE INVENTION

The present invention relates to testing materials and more particularly to a self-examination system wherein multiple copies are prepared by spirit duplication of a preprinted master containing latent images which on the copy sheet are developed on contact with a chemical reactant.

With the ever increasing work load on teachers and instructors, it becomes important to use modern technology to relieve the teacher of some of the duties ordinarily undertaken. Thus, it is possible to have preprinted spirit duplicating masters of examination forms from which the teacher can make copies for testing the students on a given subject.

Self-instructional materials also find ever increasing utility in today's education system. This convenience may include a self-examination system wherein the test sheet contains both visible and invisible images. The questions are printed in visible ink while the correct answers for each question are printed in areas in invisible ink. After marking his selection, the student uses a solvent or chemical revealing the correct answers for his selection. This type self-examination system is discussed in U.S. Pat. Nos. 3,363,336; 3,363,337 and 3,363,338.

In U.S. Pat. No. 3,451,143 there is disclosed a similar system in which the test copy containing the latent images are prepared by spirit duplication. The invisible image on the spirit duplicating master may be, for example, nickel acetate in a carnauba wax - oil formulation. The spirit fluid effects transfer of the invisible image of the master to the copy sheet. A developing fluid such as dithiooxamide in methanol is used to form the color reaction. It is also disclosed that visible images may be placed on the same copy sheets from separate or the same master. In either event, one or two transfer sheets are necessary to prepare the masters, presenting a problem for the teacher when making the master for preparing the test copies.

Such a system has also been criticized because the reactant must remain chemically dormant on the surface of the sheet for hours, days, or even months. Thus, in U.S. Pat. No. 3,682,673 to Manske, it is pointed out that when dithiooxamide is the latent image on the sheet, since it has at least some vapor pressure at room temperature, these sheets have a poor shelf-life. Accordingly, Manske suggests a system wherein the dithiooxamide reactant is encapsulated and coated on the surface of a sheet which is juxtaposed with a receptor sheet. When the microcapsules are crushed in the selected area, the latent image is transferred to the receptor sheet, which is then developed at a later time by applying to the receptor sheet a metal salt along with the solvent for the dithiooxamide reactant. This color reaction and encapsulation process is also shown in U.S. Pat. No. 3,287,154.

While encapsulation may be one solution to the problems of shelf-life present in the spirit duplicating system of U.S. Pat. No. 3,451,143, it has additional problems in that either high speed printing must be used to prepare numerous test copies well in advance of the exam or each test must be individually typewritten. Manske prepares test copies but not a spirit duplicating master for making the copies.

Therefore, the need exists for a spirit duplicating system which uses reusable pre-printed masters having a good shelf-life so that the teacher can easily prepare the exact number of test copies needed from the master for immediate self-instructional use by the students.

SUMMARY OF THE INVENTION

In accordance with the present invention, there is provided a self-examination spirit duplicating system which overcomes the problems of prior art systems. The present invention involves the use of pre-printing spirit duplicating masters containing visible and latent images. Because they are pre-printed, it is possible to prepare a booklet, box or envelope of such masters arranged, for example, by topic. In this way, when the class reaches a point where a quiz, exam or particular work lesson is appropriate, the teacher need only extract the particular pre-printed spirit duplicating master from the booklet, box or envelope and prepare copies for immediate self-instruction and use by the students.

The student, after taking the examination or doing the assignment, uses a pen or crayon containing a color developer to bring up the latent image on the sheet, revealing the correct answers or other self-instructional material. In this manner, the teacher's time is saved in three ways. In the first place, the teacher need not make up the examination. Secondly, the teacher does not have to prepare a master for making test copies. And thirdly, the copies of the examination contain latent images which can be developed by the student for self-examination, freeing the teacher from the task of grading the examinations.

In the pre-printed spirit duplicating masters of the present invention, two inks, either hot melt or solvent based, are reverse printed on the master. One contains visible images and the other the invisible images. By using a hot melt latent image ink containing a stearate or wax, a fatty acid, a mineral oil, a petrolatum, and a derivative of dithiooxamide or a solvent based latent image ink containing an alcohol, an alcohol soluble resin binder, a fatty acid and a derivative of dithiooxamide, it is possible to pre-print this ink on the masters. The masters which are prepared in this manner have a good shelf-life, resist changes in humidity, temperature, etc., are easily stored, and, on spirit duplication, render over 100 copies containing an acceptable latent image. This image may be developed by use of a nickel salt dissolved in a solvent and contained in a pen. The ingredients of the pen are non-toxic and safe for use by students of any age. Likewise, a crayon containing a color developer could be used.

Accordingly, it is an object of the present invention to provide a new and improved spirit duplicating self-examination system comprising stable, storable pre-printed spirit duplicating master having visible images and latent images which, on the copy sheet, are capable of being developed by chemical reaction.

Another object of the present invention is to provide pre-printed spirit duplicating masters containing visible and invisible images in the form of a master booklet from which the teacher may extract an examination master and prepare copies.

Other objects and advantages of the present invention will be apparent from the following description, the accompanying drawings and the appended claims.

DESCRIPTION OF THE PREFERRED EMBODIMENTS

Figure 1:
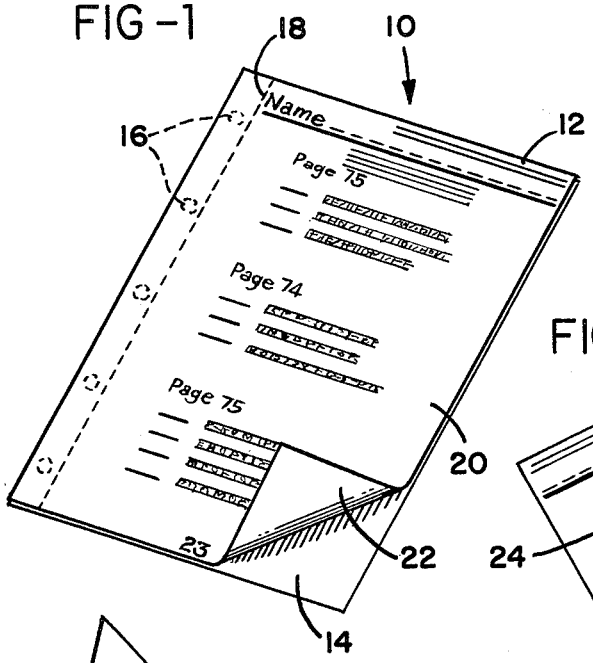
FIG. 1 is a perspective view of the upper surface of the pre-printed spirit duplicating master and protective sheet of the present invention.

Referring to FIG. 1, which illustrates a preferred embodiment of the invention, there is shown a pre-printed spirit duplicating master set 10 having a master sheet 12 and a protective sheet 14. Protective sheet 14 may be joined to the master along one edge by stapling, embossing, gluing or equivalent means. As shown in FIG. 1, sheets 12 and 14 are joined on one edge by adhesive dots 16. In that case, master sheet 12 has perforations 18 so that it may be readily torn off or detached from protective sheet 14. In FIG. 1 the perforations are along the left edge, but it should be apparent that the perforations may be at the top, sides, or both. Alternative means of protecting reverse side 22 from becoming smudged may also be used, such as individual envelopes, a protective overcoat, unattached interleaved tissue, etc. Use of a non-smudging ink makes these devices unnecessary.

The master sheet 12 has a first side 20. This side is the one which only the teacher will see and may, in addition to the material to be duplicated which is reverse printed on the back, show additional instructional material for the teacher, such as the correct answers. Backside 22 will be printed with a reverse image of that portion of the material on front side 20 which it is desired to duplicate, in addition to the latent images of the correct answers or other information.

Figure 2:
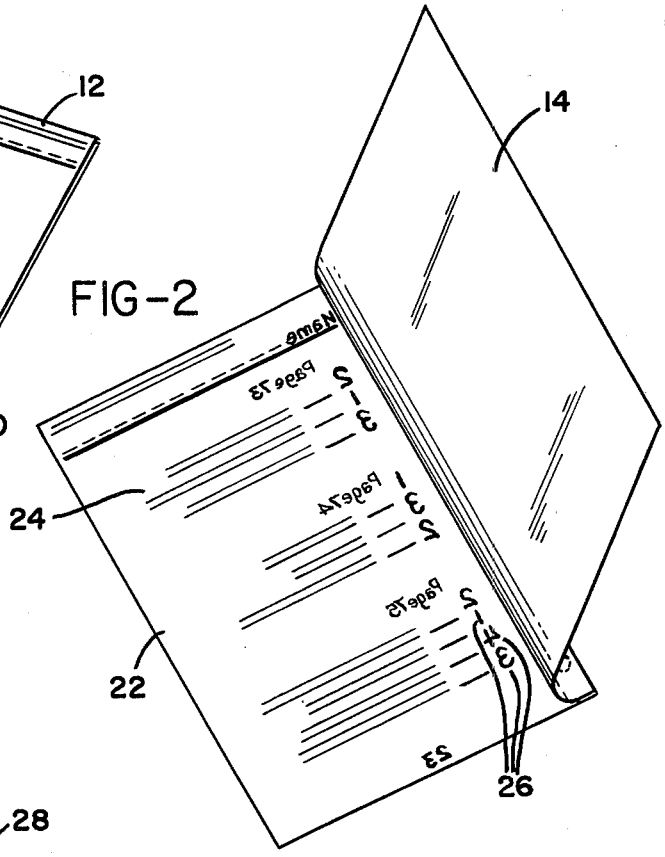
FIG. 2 is a perspective view of the backside of the pre-printed spirit duplicating master of FIG. 1.

As illustrated in FIG. 2, this reverse image contains portions 24 which will be visible on the copies and portions 26 which, while visible on the master in this case, will be invisible on the copy. Both the visible and invisible images may be hot melt inks which may be pre-printed on the master by a number of known means. For example, offset rotogravure, letterpress, stencilling and aniline printing techniques can be used. Likewise, solvent based inks may be used for either the visible or invisible image, or both, and applied by known techniques including a hot air or oven drying step.

Figure 3:
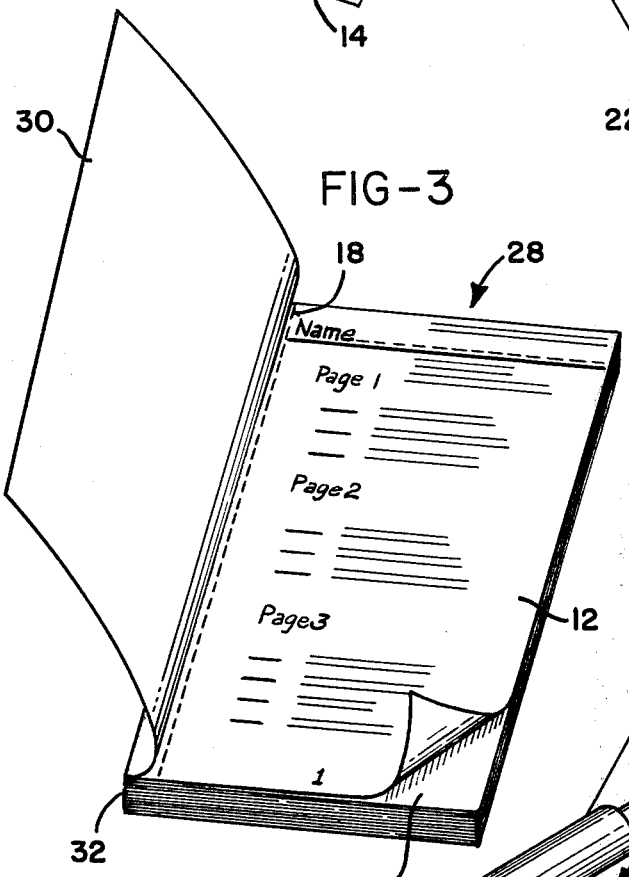
FIG. 3 is a perspective view of a booklet containing the pre-printed spirit duplicating masters of FIG. 1.

In addition, the adhesive, if one is used, is applied to the reverse side 22 for attachment of protective layer 14. Protective layer 14 keeps the images 24 and 26 from becoming smudged prior to the spirit duplication process. Thus, when a booklet of pre-printed masters is formed it will have alternative layers of the master sheets and the protective sheets. Such a booklet is shown in FIG. 3. The booklet 28 has a cover 30 and a series of master sheets 12 and interleaved protective sheets 14. It is bound along the edge 32 by any conventional means, such as by the use of an adhesive which will hold the protective sheet of each couplet as in FIG. 1 to its master sheet and also hold the master-protective sheet couplets together. Other means of binding along the edges, at the top, or in spots may be used. Perforations 18 allow removal of each individual master sheet at the appropriate time.

Figure 4:
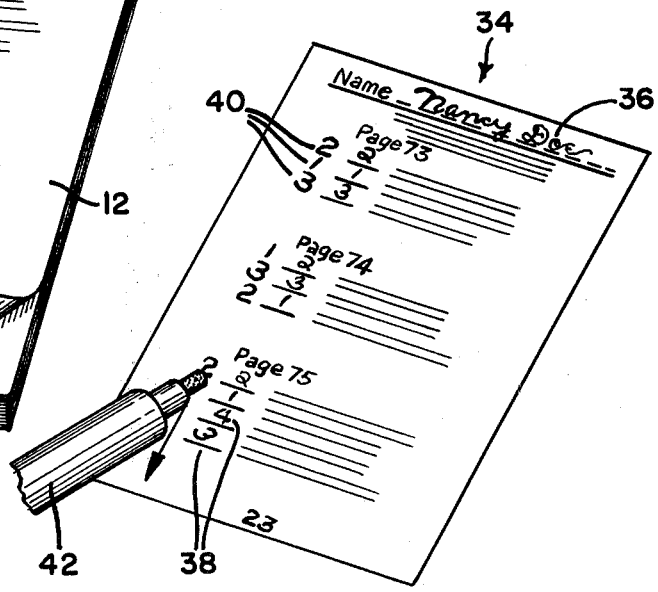
FIG. 4 is a top plan view of a copy sheet prepared from the spirit duplicating master of FIG. 1, wherein the test has been completed by the student and the latent images showing the correct answers are being developed.

When during the instructional period a point is reached when an examination or work project is to be given, the appropriate master sheet is removed from the booklet 28 and placed on a conventional spirit duplicating machine. In the spirit duplicating machine the copy paper is wetted lightly with an alcohol or "spirit" which is capable of dissolving some of the ink on the master. By contacting the "spirits" wetted paper with the master, there is a transfer of the ink to the copy paper. When the paper is dry (a matter of a few minutes because of the volatility of the "spirits"), copies are immediately available. One such copy is shown in FIG. 4. There copy 34 has been filled in by the student to the extent that she has written her name 36 in the appropriate place and answered the questions by writing answers 38 in the blanks provided.

FIG. 4 also shows the development of the latent images containing the correct answers 40. This is done by use of pen 42 containing a solvent and color developer for the latent image. As can be seen, this provides a rapid means for self-grading the examination.

It is realized that it may not always be desirable to have an examination of the self-grading form, and therefore, booklet 28 of FIG. 3 may contain both masters prepared in accordance with this invention with visible and latent images and pre-printed masters which do not contain latent images and/or other inserts such as records, film strips, transparencies, etc.

In order to obtain pre-printed masters which will yield a sufficient number of acceptable copies and which will have good shelf-life, specific formulations capable of pre-printing by the previously described techniques must be used. In terms of the visible images, any previously known hot melt spirit duplicating ink may be used. Typically these are carnauba wax based inks as described in U.S. Pat. Nos. 2,769,391; 3,122,997; and 3,436,293.

The hot melt latent image has been found to perform best when formulated according to the following general formula:

| Ingredients | Weight Percentage |
|---|---|
| Stearate or soft wax | 20 – 27 |
| Fatty acid | 8 – 17 |
| Mineral Oil | 8 – 10 |
| Petroleum jelly | 2 – 4 |
| Wetting agent | 0 – 1 |
| UV absorber | 0 – 1 |
| Color former | 44 – 54 |

The stearate or soft wax is preferably Paracin 9, a propylene glycol mono-hydroxystearate, or Paracin 13, a glycol mono-hydroxystearate, both manufactured by Baker Castor Oil Co. Other possibilities include hydroxystearates, as well as spermataceti, candelilla wax and beeswax. In addition, it has been found that when a stearate such as Paracin 9 is used, it is desirable to add to it up to 25% of a cellulose ester to control release from the master, act as a thickener, etc.

The fatty acid may be ordinary castor oil such as Castor No. 3 by Baker Castor Oil Co. of Bayonne, New Jersey. The petroleum jelly or petrolatum may be a product such as the familiar Vaselene made by Cheseborough Ponds, Inc., New York, New York. The mineral oil may be napthenic, paraffinic or mixtures such as Drakeol manufactured by Penndrake.

A small amount of an ultraviolet absorber may also be added, if desired, to diminish the effect of light or heat on the undeveloped latent image. Such UV absorbers are well known in the art, an example of which is Tinuvin P manufactured by Geigy-Ciba Chemical Co. of Ardsly, New York. The wetting agent may be an oleate, such as N-tallow-1, 3 diaminopropane dioleate sold under the designation Duomeen T-DO by Armak of Chicago, Ill., or a rendered fat, such as Blown Oil 300 manufactured by Neatsfoot Refining Co. of Philadelphia, Pennsylvania.

The preferred dithiooxamide derivatives useful as the color forming reagents in the latent image are N, N'bis-2-hydroxyethyl dithiooxamide; N,N'didodecyl dithiooxamide and N,N'dimethyl dithiooxamide. Dithiooxamide will also give a color reaction with nickel salts, but it has a darker color and tends to show too much on the copy sheet, it is slower developing, and the undeveloped images lose intensity.

The solvent system has been found to perform best when formulated according to the following general formula:

| Ingredients | Weight Percentage |
|---|---|
| Alcohol | 30 – 40 |
| Resin binder | 5 – 15 |
| Fatty acid | 8 – 17 |
| Wetting agent | 0 – 1 |
| UV absorber | 0 – 1 |
| Color former | 44 – 54 |

The alcohol may be any of the alcohols conventinally used in spirit duplicating such as ethanol. The resin binder should be an alcohol soluble material such as ethyl cellulose, alcohol soluble propionate, alcohol soluble butyrate, or Amberol 850 sold by Rohm & Haas.

As in the case of the hot melt material the fatty acid may be castor oil, the wetting agent may be an oleate or rendered fat, and the UV absorber may be Tinuvin P. The color former may be selected from the same group of dithiooxamide derivatives as previously indicated.

The color developer may be in a crayon or may conveniently be contained in a pen having a polypropylene or similar plastic body since the materials contained in the pen do not affect it and such plastics do not transmit vapors. The ingredients in the pen, in addition to a nickel salt, such as nickel chloride, may include water, an alcohol, propylene glycol, polyvinylpyrrolidone and sodium acetate. The propylene glycol is slow drying and gives shelf-life to the pen. The polyvinylpyrrolidone serves as a wetting agent and control viscosity. In addition, it has been found that ingredients such as sodium acetate aids in the development of the reaction with the dithiooxamide since the reaction between nickel salt color developer and the dithiooxamide color former takes place best in the presence of an alkaline solution. In that regard a 5% sodium acetate solution has a pH around 8.9 at 25°C.

EXAMPLE 1

Visible Image — Hot Melt Ink

| Ingredient | Weight Percentage |
|---|---|
| Carnauba wax | 21 |
| Mineral oil | 13 |
| Fatty acid | 6 |
| Petrolatum | 5 |
| Crystal violet | 55 |
| | 100% |

EXAMPLE 2

Preferred Latent Image — Hot Melt Ink

| Ingredient | Weight Percentage |
|---|---|
| Paracin 9/Ethyl Cellulose (stearate) | 20.0 |
| Castor No. 3 (fatty acid) | 12.6 |
| Drakeol 15 (mineral oil) | 9.3 |
| Vaselene (petroleum jelly) | 2.6 |
| Blown Oil 300 (wetting agent) | 1.0 |
| Tinuvin P (UV absorber) | 0.5 |
| Dithiooxamide derivatives | 54.0 |
| | 100% |

EXAMPLE 3

Alternative Latent Image — Hot Melt Ink

| Ingredient | Weight Percentage |
|---|---|
| Paracin 9 (stearate) | 26.4 |
| Castor No. 3 (fatty acid) | 15.8 |
| Drakeol (mineral oil) | 9.3 |
| Vaselene (petroleum jelly) | 2.6 |
| Blown Oil 300 (wetting agent) | 1.0 |
| Dithiooxamide derivative | 44.9 |
| | 100% |

EXAMPLE 4

Alternative Latent Image — Hot Melt Ink

| Ingredient | Weight Percentage |
|---|---|
| Paracin 9/Ethyl Cellulose (stearate) | 27.0 |
| Castor No. 3 (fatty acid) | 8.6 |
| Drakeol 15 (mineral oil) | 9.3 |
| Vaselene (petroleum jelly) | 2.6 |
| Duomeen T-DO (wetting agent) | 1.0 |
| Tinuvin P (UV absorber) | 0.5 |
| Dithiooxamide derivative | 51.0 |
| | 100% |

EXAMPLE 5

Developer

| Ingredient | Weight Percentage |
|---|---|
| n-propyl alcohol | 48 |
| $H_2O$ (distilled) | 20 |
| Propylene glycol | 16.0 |
| Sodium acetate | 10.0 |
| Polyvinylpyrrolidone | 3.0 |
| $NiCl_2.6\ H_2O$ | 3.0 |

The ink of Example 1 was used to pre-print visible images in reverse form in a spirit duplicating master. Concealed images were, in successive tests, pre-printed in reverse form on the master with the latent image formulations of Examples 2–4. The pre-printed master having the visible and latent images thereon was placed on a standard spirit duplicating machine and copies were run. In each case 100 copies were prepared and copies 1–5, 10, 25, 50, 75 and 100 were retained. Part of the invisible image on these copies was developed using a developer as disclosed in Example 5. All copies had clearly visible development of the latent images of an acceptable level, although the image of copy number 100 was slightly less intense than copy number 1.

Similarly, pre-printed masters prepared in this manner have been stored for various periods up to 1 year and then used to make copies with little or no loss of intensity in the developed latent image. Accordingly, it is possible by the present invention to prepare pre-printed masters containing both a visible and latent image which have good shelf-life, are resistant to changes in temperature and humidity, and give at least 100 acceptable copies. These masters may be attached to protective sheets and may be formed into booklets or pre-printed masters or individually supplied.

While the methods and articles herein described constitute preferred embodiments of the invention, it is to be understood that the invention is not limited to these precise methods and articles, and that changes may be made therein without departing from the scope of the invention which is defined in the appended claims.

What is claimed is:

1. A pre-printed spirit duplicating master comprising a sheet having reverse printed on the backside thereof by means of a printing technique selected from the group consisting of offset, rotogravure, letterpress, stencilling, or aniline printing, a visible image spirit duplicating ink in one area and a latent image spirit duplicating ink in another area, both said visible and latent inks, when contacted with an alcohol or spirit wetted copy paper, being capable of transfer to said copy paper to impart corresponding visible and latent images thereon, said corresponding latent image being capable of development into a second visible image by application of a color developer thereto, said latent image spirit duplicating ink containing a color former selected from the group consisting of dithiooxamide and derivatives thereof and a carrier vehicle therefor, said latent image ink being resistant to changes in temperature and humidity, capable of producing at least 100 acceptable copies and capable of making copies with little or no loss of intensity in the developed image after being stored for a period of at least up to 1 year.

2. The preprinted master of claim 1 wherein said latent image ink color former comprises a dithiooxamide derivative selected from the group consisting of N, N'bis-2-hydroxyethyl dithiooxamide, N,N'didodecyl dithiooxamide, and N,N'dimethyldithiooxamide.

3. The preprinted master of claim 2 wherein said visible spirit duplicating ink contains a crystal violet dye.

4. The preprinted master of claim 3 wherein said latent image ink is a hot melt ink, said vehicle is a stearate resin and said visible image ink is a hot melt ink containing a carnauba wax.

5. The preprinted master of claim 2 wherein said latent image ink is a hot melt ink and said vehicle is a stearate resin.

6. The preprinted master of claim 1 wherein said latent image ink is a hot melt ink and said vehicle is a stearate resin.

7. The preprinted master of claim 6 wherein said stearate is selected from the group consisting of propylene glycol monohydroxy stearate and glycol monohydroxy stearate.

8. The preprinted spirit duplicating master of claim 1 wherein said sheet has printed on the first side thereof information which is reverse printed on the back side.

9. A pre-printed spirit duplicating master having an image printed on the front side and reverse printed by means of a printing technique selected from the group consisting of offset, rotogravure, letterpress, stencilling or aniline printing on the back side a visible image spirit duplicating ink and in another area latent image spirit duplicating ink comprising by weight 20–27% stearate resin, 8–17% fatty acid, 8–10% mineral oil, 2–4% petroleum jelly, 0–1% wetting agent, 0–1% ultraviolet absorber, and 44–54% of a dithiooxamide derivative color former.

10. A pre-printed spirit duplicating master as set forth in claim 9 wherein said stearate is a polypropylene mono-hydroxystearate blended with up to 25% of a cellulose ester.

11. A pre-printed spirit duplicating master as set forth in claim 9 further including a protective sheet adhesively attached to said master to protect said spirit duplicating inks from smearing prior to use.

12. In a spirit duplicating process wherein multiple copies are prepared by contacting a master with copy paper wetted lightly with an alcohol or spirit capable of dissolving some of the ink of said master whereby ink is transferred from said master to the copy paper, the improvement comprising:

contacting said wetted copy paper with a preprinted master having reverse printed on the side thereof which contacts the copy paper, a visible image spirit duplicating ink in one area and a latent image spirit duplicating ink in another area, said latent image ink containing a color former selected from the group consisting of dithiooxamide and derivatives thereof and a carrier vehicle therefor, transferring said inks to said copy paper and forming on said copy paper a positive visible image and a positive latent image, said positive latent image containing said color former selected from the group consisting of dithiooxamide and derivatives thereof and being capable of development into a visible image by application of a color developer thereto.

13. The process of claim 12 wherein said latent image ink color former contains a dithiooxamide derivative selected from the group consisting of N, N'bis-2-hydroxyethyl dithiooxamide, N,N'didodecyl dithiooxamide, and N,N'dimethyl dithiooxamide.

14. The process of claim 13 wherein said visible spirit duplicating ink contains a crystal violet dye.

15. The process of claim 14 wherein said latent image ink is a hot melt ink, said vehicle is a stearate resin, and said visible image ink is a hot melt ink containing a carnauba wax.

16. The process of claim 13 wherein said latent image ink is a hot melt ink and said vehicle comprises a stearate.

17. The process of claim 12 wherein said latent image ink is a hot melt ink and said vehicle is a stearate resin.

18. The process of claim 17 wherein said stearate is selected from the group consisting of propylene glycol monohydroxy stearate and glycol mono-hydroxy stearate.

* * * * *